US010493333B2

(12) United States Patent
Mizutani

(10) Patent No.: US 10,493,333 B2
(45) Date of Patent: Dec. 3, 2019

(54) GOLF CLUB HEAD

(71) Applicant: SUMITOMO RUBBER INDUSTRIES, LTD., Kobe-shi, Hyogo (JP)

(72) Inventor: Naruhiro Mizutani, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/855,464

(22) Filed: Dec. 27, 2017

(65) Prior Publication Data

US 2018/0178091 A1 Jun. 28, 2018

(30) Foreign Application Priority Data

Dec. 28, 2016 (JP) ..... 2016-255813

(51) Int. Cl.
*A63B 53/04* (2015.01)

(52) U.S. Cl.
CPC .. *A63B 53/0466* (2013.01); *A63B 2053/0416* (2013.01); *A63B 2053/0433* (2013.01)

(58) Field of Classification Search
CPC ..... A63B 2053/0458; A63B 2053/0462
USPC ..... 473/324–350
See application file for complete search history.

(56) References Cited

U.S. PATENT DOCUMENTS 4,512,583 A * 4/1985 Leveque de Vilmorin ..... A63B 53/04 473/245
5,232,224 A * 8/1993 Zeider ..... A63B 53/04 473/345
6,926,618 B2 * 8/2005 Sanchez ..... A63B 53/04 473/329
7,294,064 B2 * 11/2007 Tsurumaki ..... A63B 53/0466 473/329
7,448,961 B2 * 11/2008 Lin ..... A63B 53/04 473/332
7,892,109 B2 * 2/2011 Rice ..... A63B 60/00 473/329
8,231,481 B2 * 7/2012 Takechi ..... A63B 53/0466 473/342
8,235,841 B2 * 8/2012 Stites ..... A63B 53/04 473/328
8,517,858 B2 * 8/2013 Soracco ..... A63B 53/0466 473/329
8,517,860 B2 * 8/2013 Albertsen ..... A63B 53/0466 473/329

(Continued)

FOREIGN PATENT DOCUMENTS

JP 2000102632 A * 4/2000
JP 2004351173 A * 12/2004

(Continued)

OTHER PUBLICATIONS

Japanese Office Action, Notification of Reason for Rejection issued in 2016-255813, dated Nov. 28, 2017.

*Primary Examiner* — Alvin A Hunter

(74) *Attorney, Agent, or Firm* — Birch, Stewart, Kolasch & Birch, LLP

(57) ABSTRACT

A golf club head according to the present invention includes a face portion, a crown portion, and a sole portion. The face portion has a thin-walled portion on a peripheral edge on a toe side. The sole portion has an easily deformable portion extending in a toe-to-heel direction, on at least a heel side.

12 Claims, 5 Drawing Sheets

(56) References Cited

U.S. PATENT DOCUMENTS

| | | | | |
|---|---|---|---|---|
| 8,821,312 | B2 * | 9/2014 | Burnett | A63B 53/0466 473/329 |
| 8,827,831 | B2 * | 9/2014 | Burnett | A63B 53/0466 473/329 |
| 8,834,289 | B2 * | 9/2014 | de la Cruz | A63B 53/0466 473/329 |
| 8,834,290 | B2 * | 9/2014 | Bezilla | A63B 53/0466 473/329 |
| 8,888,607 | B2 * | 11/2014 | Harbert | A63B 53/04 473/307 |
| 8,961,332 | B2 * | 2/2015 | Galvan | A63B 53/0466 473/329 |
| 8,986,133 | B2 * | 3/2015 | Bennett | A63B 53/06 473/329 |
| 9,017,187 | B2 * | 4/2015 | Abe | A63B 53/0466 473/329 |
| 2011/0218053 | A1 | 9/2011 | Tang et al. | |
| 2015/0038256 | A1 | 2/2015 | Ashino | |
| 2016/0354654 | A1 | 12/2016 | Kato | |

FOREIGN PATENT DOCUMENTS

| | | | | | |
|---|---|---|---|---|---|
| JP | 2004358225 | A | * | 12/2004 | A63B 53/0466 |
| JP | 2005245576 | A | * | 9/2005 | |
| JP | 2006087928 | A | * | 4/2006 | |
| JP | 2013-500075 | A | | 1/2013 | |
| JP | 5583827 | B1 | | 9/2014 | |
| JP | 2015107339 | A | * | 6/2015 | A63B 53/04 |
| JP | 5848839 | B1 | | 1/2016 | |
| JP | 2017012769 | A | * | 1/2017 | A63B 53/0466 |
| WO | WO 2011/011699 | A1 | | 1/2011 | |

* cited by examiner

E1 Cross-section

GOLF CLUB HEAD

TECHNICAL FIELD

The present invention relates to a golf club head.

BACKGROUND ART

Many improvements have been made to the head of wood-type golf clubs over the years, and various proposals have been made particularly with regard to the face portion that hits the ball. Generally, given that it is the central area of the face portion that mostly hits the ball, thickness has been increased and mechanical strength has been improved. On the other hand, the area to the toe side or the heel side of the central area is made thinner than the central area, thereby improving the rebound performance. For example, with the golf club disclosed in Patent Literature 1, a thin-walled portion is formed on the periphery on the toe-side and the heel-side of the face portion, and the area having a high rebound performance is extended to the toe side and heel side.

JP 5583827 is an example of related art.

However, with golf clubs such as the above, even though the rebound performance on the toe side and the heel side can be enhanced, there is a problem in that durability is reduced, since the thin-walled portion is formed on both sides of the face portion in the toe-heel direction. The present invention was made in order to solve the above problems, and an object thereof is to provide a golf club head that is able to improve the rebound performance, while suppressing a reduction in the durability of the face portion.

SUMMARY OF THE INVENTION

A golf club head according to the present invention is provided with a face portion, a crown portion and a sole portion, the face portion having a thin-walled portion in a peripheral portion on a toe side, and the sole portion having, at least on a heel side, a readily deformable portion extending in a toe-heel direction.

In the above golf club head, a configuration can be adopted in which the readily deformable portion extends from a vicinity of an end portion on the heel side of the sole portion to a vicinity of a center in the toe-heel direction.

In the above golf club head, a configuration can be adopted in which the readily deformable portion is formed by a groove portion, and a depth of the groove portion becomes shallower from the heel side to the toe side.

In the above golf club heads, a configuration can be adopted in which the readily deformable portion is formed in a position that is less than 25 mm from the face portion in the face-back direction.

In the above golf club heads, a configuration can be adopted in which the thin-walled portion of the face portion has an inflected shape where a first region along the crown portion side connects to a second region along the sole portion side.

In the above golf club heads, a configuration can be adopted in which, when the golf club head is viewed in a back direction from the face portion side, the thin-walled portion of the face portion and the readily deformable portion of the sole portion are arranged so as to oppose each other across a center of the face portion.

In the above golf club heads, a configuration can be adopted in which the crown portion is constituted by a first peripheral area along the face portion and a first main body area, the sole portion is constituted by a second peripheral area along the face portion and a second main body area, and a golf club head main body having an opening surrounded by the two main body areas is formed, by the first main body area of the crown portion and the second main body area of the sole portion, a face member is constituted by the face portion, the first peripheral area and the second peripheral area, the golf club head is formed by the first and second peripheral areas of the face member being joined to a periphery of the opening of the golf club head main body, and the readily deformable portion is formed in the second main body area.

With the golf club head according to the present invention, the rebound performance can be improved, while suppressing a reduction in the durability of the face portion.

EMBODIMENTS OF THE INVENTION

Hereinafter, an embodiment of a golf club head according to the present invention will be described, with reference to the drawings.

1. Overview of Golf Club Head

Figure 1:
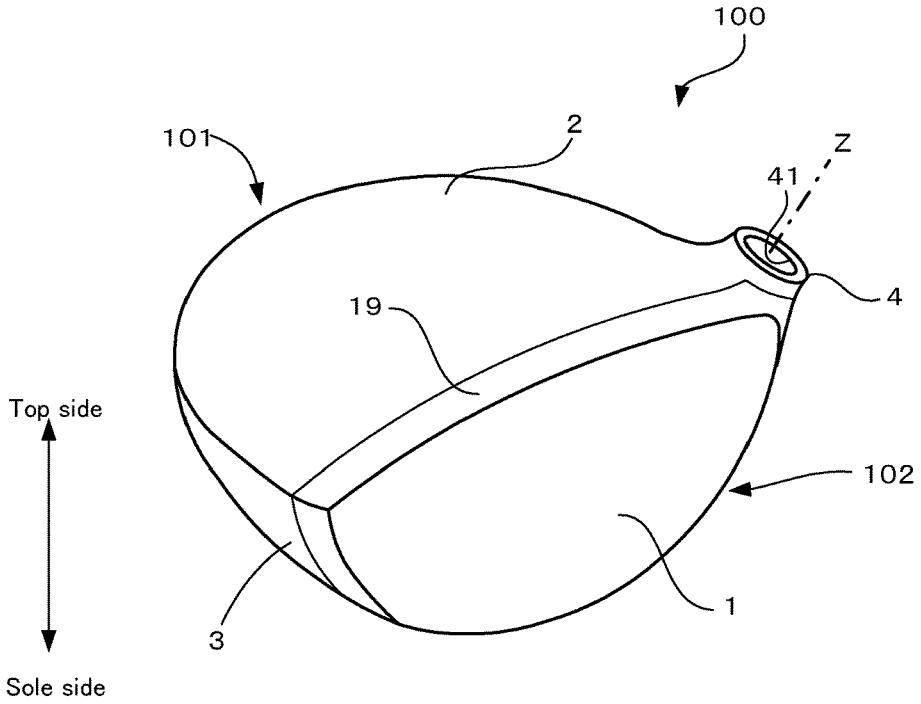
FIG. 1 is a perspective view of a reference state of a golf club head according to the present embodiment.
Figure 2:
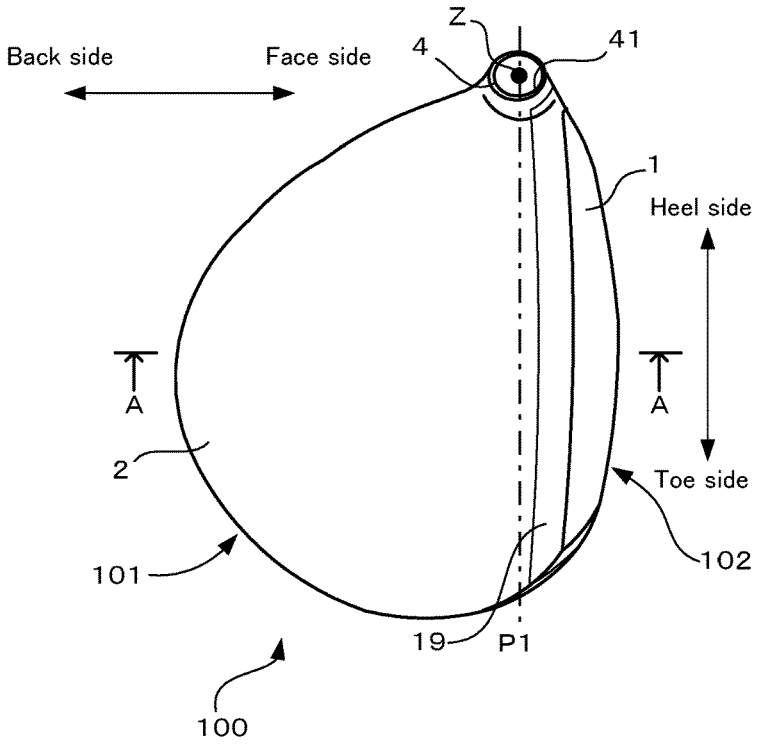
FIG. 2 is a plan view of FIG. 1.
Figure 3:
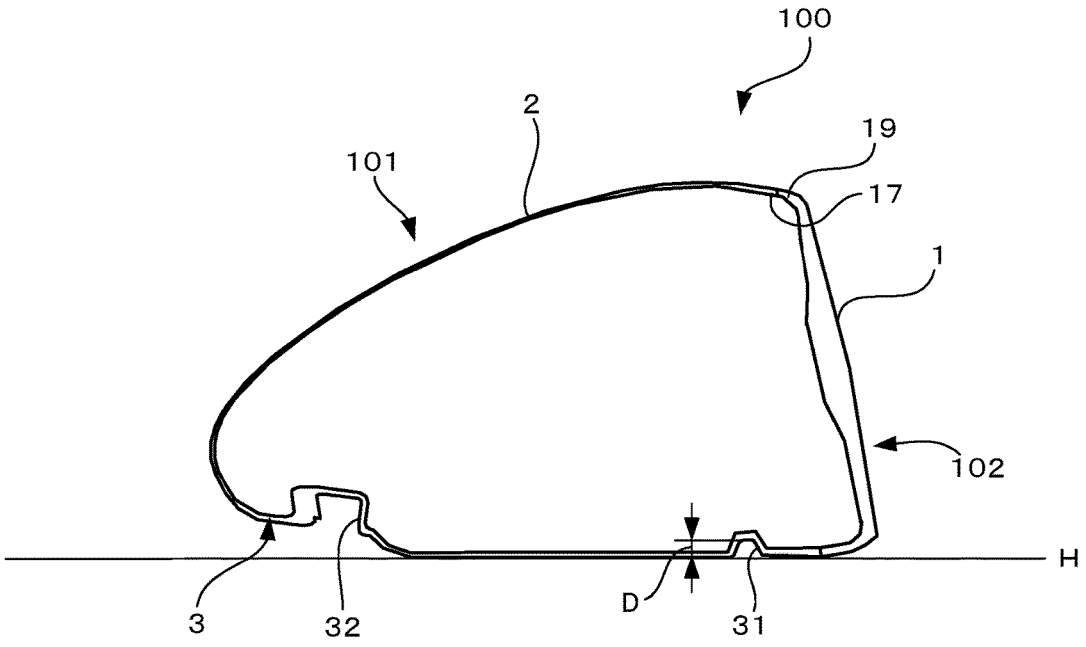
FIG. 3 is cross-sectional view along an A-A line of FIG. 2.

FIG. 1 is a perspective view of this golf club head, FIG. 2 is a plan view in a reference state of the head, and FIG. 3 is a cross-sectional view along an A-A line of FIG. 2. As shown in FIG. 1, this golf club head (hereinafter, may be simply referred to as "head") 100 is a wood-type golf club head that is a hollow structure having an interior space, and whose wall surfaces are formed by a face portion 1, a crown portion 2, a sole portion 3 and a hosel portion 4. Specifically, the present invention can be applied to golf club heads such as utilities, fairway woods and drivers.

The face portion 1 has a face surface which is the surface that hits the ball, and the crown portion 2 adjoins the face portion 1 and constitutes the upper surface of the head 100. The sole portion 3 mainly constitutes the bottom surface of the head 100, and constitutes the outer perimeter surface of the head 100 other than the face portion 1 and the crown portion 2. That is, besides the bottom surface of the head 100, the region extending from the toe side of the face portion 1 around the back side of the head to the heel side of the face portion 1 is also part of the sole portion 3. Furthermore, the hosel portion 4 is a region that is provided adjoining the heel side of the crown portion 2, and has an insertion hole 41 into which the shaft (illustration omitted)

of the golf club is inserted. A central axis line Z of this insertion hole 41 coincides with the axis line of the shaft.

Here, the reference state when setting the golf club head 100 on the ground will be described. First, as shown in FIG. 2, a state in which the central axis line Z is contained in a plane P1 that is perpendicular to the ground and the head is placed on the ground at a predetermined lie angle and real loft angle is prescribed as the reference state. The plane P1 is called a reference perpendicular plane. Also, as shown in FIG. 2, the direction of the line of intersection between the reference perpendicular plane P1 and the ground is called the toe-heel direction, and the direction perpendicular to this toe-heel direction and parallel to the ground is called the face-back direction.

Figure 4A:
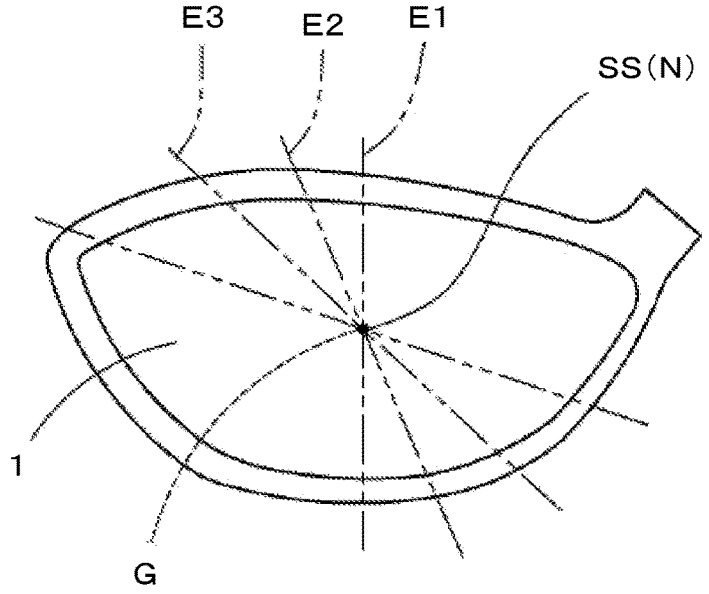
FIG. 4A is a diagram illustrating the boundary of a face portion.
Figure 4B:
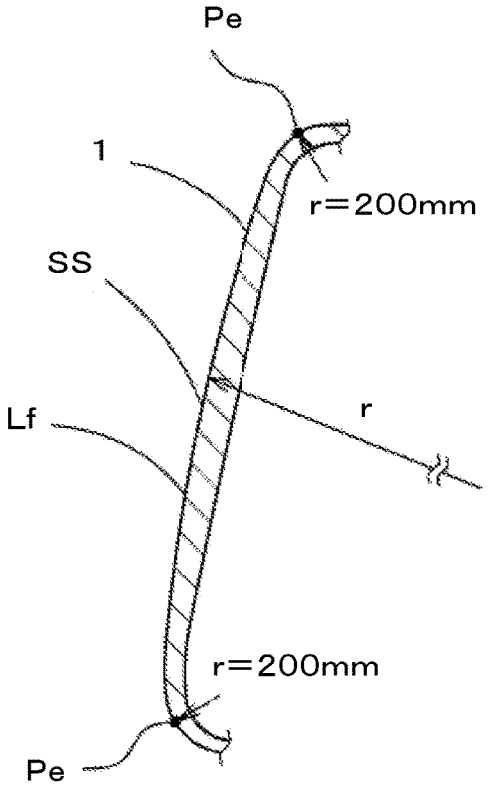
FIG. 4B is a diagram illustrating the boundary of the face portion.

In the present embodiment, the boundary between the face portion 1 and the crown portion 2 and between the face portion 1 and the sole portion 3 can be defined as follows. That is, in the case where a ridgeline is formed therebetween, this ridgeline will be the boundary. On the other hand, in the case where a clear ridgeline is not formed, in each of cross-sections E1, E2, E3 and so forth that contain a straight line N connecting a head center of gravity G and a sweet spot SS, as shown in FIG. 4A, a position Pe at which a radius of curvature r of a contour Lf of the face outer surface first reaches 200 mm from the sweet spot side toward the face outer side will be the periphery of the face portion 1, as shown in FIG. 4B, and this periphery is defined as the boundary with the crown portion 2 or the sole portion 3. Note that the sweet spot SS is the point of intersection between the normal (straight line N) of the face surface that passes through the head center of gravity G and this face surface.

Also, in the present embodiment, the boundary between the crown portion 2 and the sole portion 3 can be defined as follows. That is, in the case where a ridgeline is formed between the crown portion 2 and the sole portion 3, this ridgeline will be the boundary. On the other hand, in the case where a clear ridgeline is not formed therebetween, the contour seen when the head is set in the reference state and viewed from directly above the center of gravity of the head 100 will be the boundary.

Also, the head 100 can be formed with a titanium alloy (Ti-6Al-4V, Ti-8Al-1Mo-1V, etc.) whose specific gravity is approximately about 4.4 to 4.5, for example. Other than a titanium alloy, the head 100 can also be formed using one type or two or more types of material including stainless steel, maraging steel, an aluminum alloy, a magnesium alloy or an amorphous alloy, for example.

Also, the volume of this golf club head 100 is desirably from 90 $cm^3$ to 460 $cm^3$ inclusive, for example.

2. Structure of Face Portion

Figure 5:
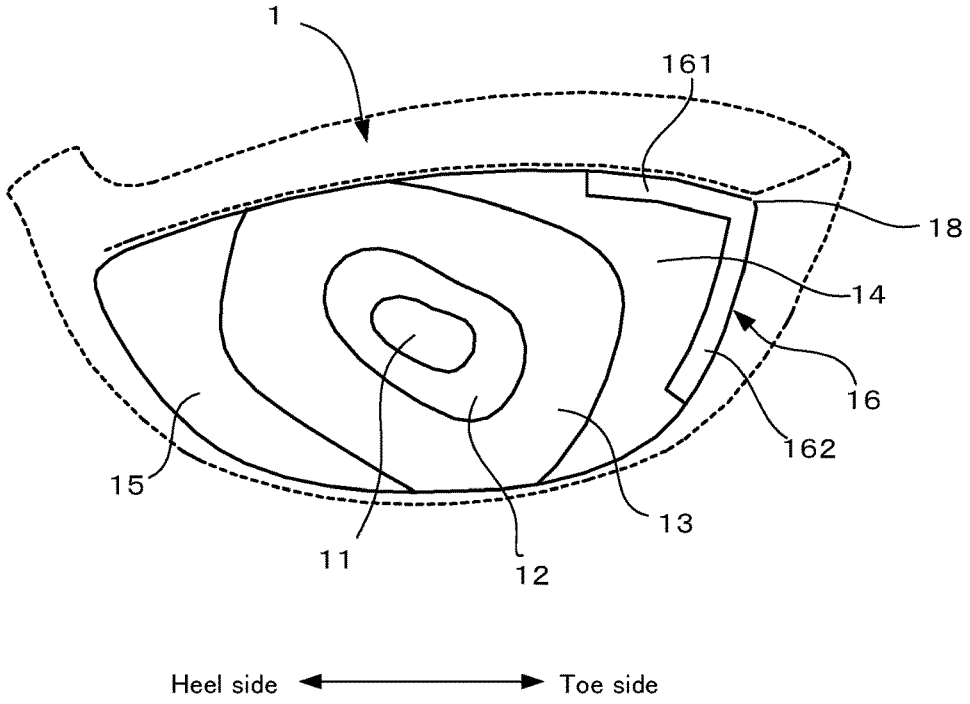
FIG. 5 is a rear view of an inner surface of the face portion as seen from the back side.

Next, the face portion 1 will be described, with reference also to FIG. 5. FIG. 5 is a rear view of an inner surface of the face portion as seen from the back side. As shown in FIGS. 3 and 5, in the face portion 1, the surface facing outside is formed to be flat, whereas the surface facing inside is formed to be irregular. The face portion 1 is thereby constituted by a plurality of areas having different thicknesses. As shown in FIG. 5, a substantially rectangular central area 11 is provided in a vicinity of the center of the face portion 1 in the up-down direction and the left-right direction (toe-heel direction). A first transition area 12 whose thickness changes is formed, so as to surround this central area 11. Also, a second transition area 13 whose thickness changes is formed so as to surround this first transition area 12. On the toe side and the heel side of this second transition area 13, a toe peripheral area 14 and a heel peripheral area 15 whose respective thicknesses are constant are formed, and the toe peripheral area 14 and the heel peripheral area 15 extend to the periphery of the face portion 1. Furthermore, on an edge portion on the toe side of the toe side peripheral area 14, a V-shaped thin-walled portion 16 is formed.

The central area 11 is the area having the greatest thickness, and the wall thickness thereof is preferably set to 3.0 to 4.2 mm, and more preferably set to 3.4 to 3.8 mm, for example. This central area 11 is formed in a substantially rectangular shape, and the long sides thereof extend in the direction connecting a lower portion on the toe side and an upper portion on the heel side. The first transition area 12 is formed such that the wall thickness gradually decreases moving away from the central area 11, and the wall thickness thereof can be set to 2.8 to 3.4 mm, for example. Also, the outer edge is formed to be substantially rectangular similarly to the central area 11, and the orientation thereof is also substantially the same as the central area 11.

The second transition area 13 is formed such that the wall thickness gradually decreases moving away from the first transition area 12, and the wall thickness thereof can be set to 1.8 to 2.6 mm, for example. Also, the outer edge of the second transition area 13 is formed in a substantially rectangular shape, and the upper and lower corner portions contact an edge portion of the face portion 1. Also, these upper and lower corner portions are located roughly in the direction in which the long sides of the central area 11 extend. On the other hand, the other two corner portions of the second transition area 13 are arranged on the toe side and the heel side.

The peripheral areas 14 and 15 are respectively arranged further to the toe side and the heel side than the second transition area 13, and the wall thickness thereof can be set to 1.5 to 2.4 mm, for example. The heel side peripheral area 15 extends, on the heel side, between the second transition area 13 and the periphery of the face portion 1. On the other hand, the toe side peripheral area 14 extends on the toe side between the second transition area 13 and the periphery of the face portion 1, and the thin-walled portion 16, which is thinner than the toe side peripheral area 14, is formed in a corner portion 18 on the toe side of the face portion 1, or in other words, in the portion in which the crown portion 2 connects to the sole portion 3.

The thin-walled portion 16 is formed in a V-shape where a first region 161 along the crown portion 2 is connected to a second region 162 along the sole portion 3. More specifically, the first region 161 extends between the corner portion 18 on the toe side of the face portion 1 and the corner portion on the upper side of the second transition area 13, but does not contact the second transition area 13. On the other hand, the second region 162 extends between the corner portion 18 on the toe side of the face portion 1 and the corner portion on the lower side of the second transition area 13, but does not contact the second transition area 13. The wall thickness of the thin-walled portion 16 is preferably set to 1.0 to 1.8 mm, and more preferably set to 1.2 to 1.6 mm, for example. Note that the numerical values related to the above thicknesses are examples, and are, in particular, numerical values suitable for the case where the golf club head is a driver. Therefore, in the case of a golf club heads other than a driver, the dimensions can be made smaller than the above numerical values, for example.

3. Structure of Sole Portion

Figure 6:
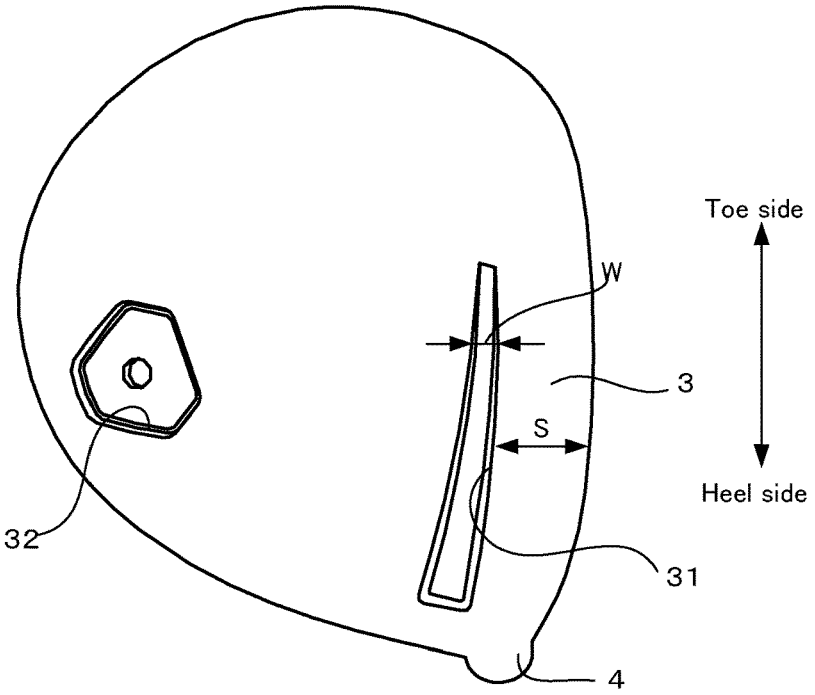
FIG. 6 is a plan view of a sole portion.

Next, the face portion 1 will be described, with reference also to FIG. 6. FIG. 6 is a plan view of the sole portion. As shown in this diagram, a plurality of irregularities are formed in the sole portion 3 for reasons of design and the like, and, in particular, in the present embodiment, a groove portion 31 extending in the toe-heel direction is formed on the face portion 1 side. Also, in a vicinity of an edge portion of the sole portion 3 further to the back side than this groove portion 31, a hexagonal recessed portion 32 is formed, and weights (illustration omitted) can be arranged in this recessed portion 32.

The groove portion 31 extends from a vicinity of an end portion of the sole portion 3 on the heel side to a vicinity of the center in the toe-heel direction. A width W of the groove portion 31 is becomes gradually smaller from the heel side toward the toe side, and the width W thereof can be set to 2.0 to 15.0 mm, for example. A depth D of the groove portion 31 also becomes gradually shallower from the heel side toward the toe side, and the depth D thereof can be set to 0.8 to 3.0 mm, for example, at the deepest point.

The groove portion 31 extends roughly parallel to the edge portion of the sole portion 3 on the face portion 1 side, and a distance S from the face portion 1 can be set to 25.0 mm or less. Adopting this configuration contributes to an improvement in the rebound performance of the face portion 1, as will be discussed later. However, in the case of adopting a cup face structure which will be discussed later, the groove portion 31 can be arranged further to the back side than the position where a peripheral portion 19 of a face member 102 joins the sole portion 3 of a head main body 101.

4. Assembly Structure of Golf Club Head

The golf club head 100 according to the present embodiment is, as shown in FIG. 3, constituted by assembling a head main body 101 having the crown portion 2 and the sole portion 3, and a cup-shaped face member 102 having the face portion 1 and a peripheral portion 19 that extends from a periphery of the face portion 1. This head main body 101 has an opening 17 surrounded by the crown portion 2 and the sole portion 3, and the face member 102 is attached so as to close this opening 17. That is, the end surface of the peripheral portion 19 of the face member 102 is butted against the end surface of the opening 17 of the head main body 101, and these end surfaces are joined by welding (so-called cup face structure). The face member 102 is then integrated with the head main body 101 by being attached to the edge portion of the opening 17 of the head main body 101, and the peripheral portion 19 of the face member 102 thereby functions as part of the crown portion 2 and the sole portion 3 of the head 100.

Accordingly, the surfaces that are integrally formed as a result of the peripheral portion (first peripheral area and second peripheral area) 19 of the face member 102 being attached to the head main body 101 constitute the crown portion 2 and the sole portion 3 of the head 100. Thus, strictly speaking, the crown portion (first peripheral area) 2 and the sole portion (second peripheral area) 3 of the head main body 101 are part of the crown portion 2 and the sole portion 3 of the head 100, although, in this specification, these portions of the head main body 101 may also be referred to simply as the crown portion 2 and the sole portion 3, without making this distinction.

5. Manufacturing Method for Golf Club Head

Next, an example of a manufacturing method for the above golf club head will be described. First, the head main body 101 and the face member 102 described above are prepared. Such a head main body 101 and face member 102 can be produced with various methods. For example, the head main body 101 can be manufactured by casting such as a well-known lost wax precision casting method. Also, the face member 102 can be manufactured using a forging method, plate pressing, casting or the like, for example. Also, the unprocessed flat plate of the face member 102 that is used at this time is processed such that the rolling direction substantially coincides with the direction from the upper portion on the toe side of the face portion 1 toward the lower portion on the heel side.

A golf club head base material is completed when predetermined coating is performed after joining these members by welding (TIG (tungsten inactive gas) welding, plasma welding, laser welding, brazing, etc.), for example.

6. Features

According to the above embodiment, the following effects can be obtained.

(1) In the present embodiment, the thin-walled portion 16 is formed on the edge portion on the toe side of the face portion 1, thus inducing flexure on the toe side of the face portion 1, and enabling the rebound performance to be improved. In particular, since the thin-walled portion 16 is formed in a V-shape, the rebound performance in the portion from the corner portion 18 on the toe side of the face portion 1 toward the central area 11 can be improved, since flexure can be induced in the area surrounded by this V-shape, or in other words, in the area toward the central area 11 which is the center of the face portion 1. However, in the face portion 1, the thin-walled portion 16 is only formed on the toe side, and is not formed on the heel side. A reduction in the durability of the face portion 1 is thereby prevented.

Also, the groove portion 31 extending in the toe-heel direction is formed in the sole portion 3, and since the sole portion 3 can thereby be allowed to flex in the face-back direction when the ball is hit with the face portion 1, rebound performance can be improved. In particular, since the groove portion 31 is arranged on the heel portion side, the rebound performance on the heel side of the face portion 1 can be improved.

In this way, in the present embodiment, the rebound performance on both the toe side and the heel side of the face portion 1 can be improved as a result of the thin-walled portion 16 of the face portion 1 and the groove portion 31 of the sole portion 3. That is, the area having a high rebound performance can be extended from the central area 11 to the toe side and the heel side. On the other hand, since the thin-walled portion 16 is only formed on the toe side in the face portion 1, a reduction in the durability of the face portion 1 can be prevented. Note that, in the present embodiment, the face portion 1 is formed with a cup face structure, and the face member 102 and the head main body 101 are formed with separate members. Since the durability of the head main body 101 is not required to be as high as the face portion 1, durability is not adversely affected, even if the groove portion 31 is formed in the sole portion 2 of the head main body 101.

(2) As described above, the groove portion 31 is arranged on the heel side, and becomes narrower and shallower toward the toe side. Thus, an improvement in the rebound performance resulting from the groove portion 31 will appear mainly on the heel side. The following effects can thereby be obtained. For example, when the groove portion 31 is made wider and deeper in a vicinity of a portion directly under the central area 11 of the face portion 1, an improvement in rebound performance could possibly be extended to this portion. However, since the area extending above and below the central area 11 of the face portion 1 is the longest portion, rebound is readily obtained in this area. Accordingly, the width and depth of the groove portion 31 are adjusted as described above, such that the improvement in rebound performance in this area does not become excessive. As a result, an excessive improvement in the rebound performance in a vicinity of the center of the face portion 1 in the toe-heel direction is suppressed, and the rebound performance on the heel side is improved, thus enabling the area having a high rebound performance on the face portion 1 to be appropriately extended.

(3) The thin-walled portion 16 of the face portion 1 and the groove portion 31 of the sole portion 3, when viewing the face portion 1 toward the back side from the front, are arranged so as to oppose each other across the central area 11. The area having a high rebound performance is thereby formed from an upper portion on the toe side of the face portion 1 toward a lower portion on the heel side of the face portion 1. This area will be referred to as a high rebound area Z. The following advantages are thereby obtained.

Figure 7:
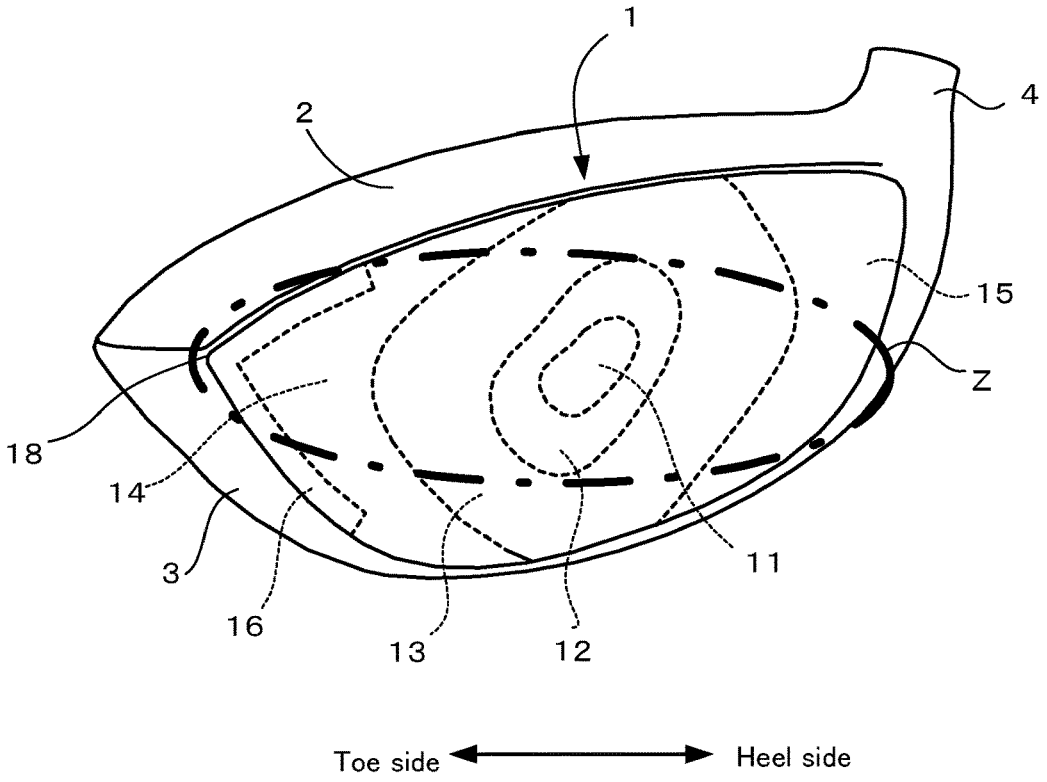
FIG. 7 is a front view showing the state of the head at impact.

The shaft of the golf club bends during the swing and the toe side of the head tends to drop slightly. Thus, the ball will be hit in a state where the toe side of the head has dropped and the heel side is raised. As a result, the high rebound area Z formed as described above is, at impact, oriented in a manner approaching the horizontal, as shown in FIG. 7 (for convenience of description, however, FIG. 7 exaggerates the orientation of the high rebound area Z toward the horizontal). Thus, variation in the impact point of the golfer in the horizontal direction can be covered, and the ball can be hit in the high rebound area Z at whatever position the ball is hit. Accordingly, even if the impact point is outside the central area 11, the ball can be hit with high rebound. As a result, variation in the driving distance due to variation in the impact point can be suppressed.

Figure 8A:
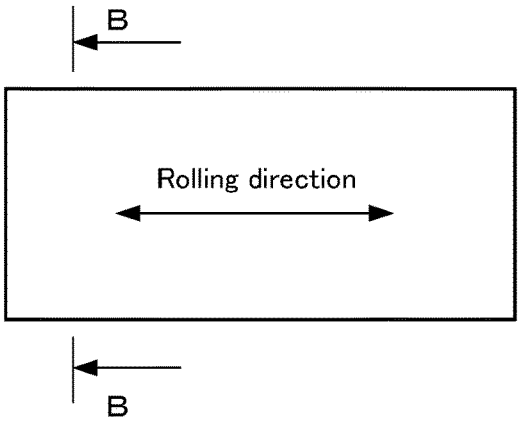
FIG. 8A is a plan view of a flat plate constituting a face member.
Figure 8B:
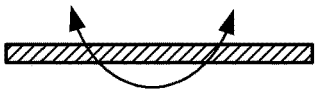
FIG. 8B is cross-sectional view along a B-B line of FIG. 8A.

(4) Generally, the flat plate that is formed by rolling tends to flex in a direction (arrows) orthogonal to the rolling direction, as shown in FIG. 8B. Thus, when the rolling direction of the flat plate of the face member 102 is caused to roughly coincide with the direction in which the high rebound area Z extends, as described above, the rebound performance in the high rebound area can be further improved.

(5) Since the groove portion 31 is formed in the sole portion 3, the surface area of the sole portion 3 is increased, and, as a result, the weight of the sole portion 3 can be increased. In particular, since the weight on the heel side can be increased, the center of gravity of the head can be moved to the heel side of the sole portion 3. As a result, the head is readily rotated about the shaft axis during the swing and the face surface is readily returned to be square with the target line at impact. Thus, it becomes easier to hit the ball in the target direction.

7. Variations

Although an embodiment of the present invention has been described above, the present invention is not limited to the above embodiment, and various modifications can be made, without departing from the gist of the invention. Also, the following variations can be combined as appropriate. For example, the following modifications can be made.

7-1

In the embodiment, the rebound performance of the face portion 1 is improved, by forming the groove portion 31 in the sole portion 3, but a readily deformable portion according to the present invention can be configured with other structures. For example, a thin-walled portion extending in the toe-heel direction can be formed in a similar position to the groove portion 31. Such a thin-walled portion can be formed by recessing one or both of the outer wall surface and the inner wall surface of the sole portion 3.

Alternatively, a readily deformable portion of the present invention can also be formed by forming a through hole in the position at which the groove portion is formed, and embedding a readily deformable member in this through hole.

7-2

The readily deformable portion of the sole portion 3 is not particularly limited in terms of position and length, and need only be arranged at least on the heel side. Accordingly, the readily deformable portion can also be provided to extend to a vicinity of the center in the toe-heel direction or to extend beyond the center. Also, the width and depth of the groove portion 31 can be changed as appropriate. Furthermore, the readily deformable portion need only extend roughly, and not necessarily precisely, in the toe-heel direction.

7-3

The thin-walled portion 16 of the face portion 1 is not particularly limited in terms of configuration and shape, and need only be provided in a peripheral portion on the toe side. In the above embodiment, the thin-walled portion 16 is formed in a V-shape so as to sandwich the corner portion 18 on the toe side of the face portion 1, but the present invention is not particularly limited thereto, and other configurations can be adopted, such as forming the thin-walled portion with only the first region 161 along the crown portion 2 or only the second region 162 along the sole portion 3. Also, the thin-walled portion 16 does not need to follow the periphery of the face portion 1 perfectly, and may be formed at a position slightly away from the periphery.

7-4

Although the head according to the above embodiment has a cup face structure, other configurations may be adopted. For example, a head main body having the face portion 1 and the sole portion 3 and in which an opening for the crown portion 2 is formed can be prepared, and the head can be constituted by fitting the crown portion into the opening. A cup face structure need not be adopted, and a flat face member can also be fixed to the head main body.

7-5

The shape of the sole portion 3 is not particularly limited, and at least a readily deformable portion such as the groove portion described above need only be provided. Accordingly, other designs such as a recessed portion or the like can be adopted as appropriate.

LIST OF REFERENCE NUMERALS

1 Face portion
16 Thin-walled portion
2 Crown portion
3 Sole portion
31 Groove portion (Readily deformable portion)
4 Hosel portion

What is claimed is:

1. A golf club head comprising:

a face portion including a face surface configured to hit a golf ball;

a crown portion; and a sole portion, wherein the face surface has a thin-walled portion in a peripheral portion on a toe side, wherein a thickness of the thin-walled portion is the smallest in the face surface, wherein the sole portion has, at least on a heel side, a readily deformable portion extending in a toe-heel direction, wherein the readily deformable portion extends from a vicinity of an end portion on the heel side of the sole portion to a vicinity of a center in the toe-heel direction, and wherein the readily deformable portion is formed by a groove portion, and a depth of the groove portion becomes shallower from the heel side to the toe side.

2. The golf club head according to claim 1, wherein the readily deformable portion is formed in a position that is less than 25 mm from the face portion in the face-back direction.

3. The golf club head according to claim 1, wherein the thin-walled portion of the face portion has an inflected shape where a first region along the crown portion side connects to a second region along the sole portion side.

4. The golf club head according to claim 1, wherein, when the golf club head is viewed in a back direction from the face portion side, the thin-walled portion of the face portion and the readily deformable portion of the sole portion are arranged so as to oppose each other across a center of the face portion.

5. A golf club head comprising:

a face portion including a face surface configured to hit a golf ball, a crown portion; and a sole portion, wherein the face surface has a thin-walled portion in a peripheral portion on a toe side, wherein a thickness of the thin-walled portion is the smallest in the face surface, wherein the sole portion has, at least on a heel side, a readily deformable portion extending in a toe-heel direction, wherein, when the golf club head is viewed in a back direction from the face portion side, the thin-walled portion of the face portion and the readily deformable portion of the sole portion are arranged so as to oppose each other across a center of the face portion, wherein the face portion is formed from a flat plate, and wherein when the golf club head is viewed in a back direction from the face portion side, the direction from the thin-walled portion of the face portion to the readily deformable portion of the sole portion substantially coincides with the rolling direction of the flat plate.

6. A golf club head comprising:

a face portion including a face surface configured to hit a golf ball;

a crown portion; and a sole portion, wherein the face surface has a thin-walled portion in a peripheral portion on a toe side, wherein a thickness of the thin-walled portion is the smallest in the face surface, wherein the sole portion has, at least on a heel side, a readily deformable portion extending in a toe-heel direction, wherein the face portion is formed from a flat plate, and wherein the rolling direction of the flat plate substantially coincides with the direction from the upper portion on the toe side of the face portion toward the lower portion on the heel side.

7. The golf club head according to claim 1, wherein a thick-walled central area is provided in a vicinity of the center of the face surface, a thickness of the central area is the largest in the face surface, the central area is shaped in substantially rectangular, and the long sides of the central area extend in the direction connecting a lower portion on the toe side and an upper portion on the heel side.

8. The golf club head according to claim 7, wherein a transition area is provided to surround the central area, the transition area is formed such that the wall thickness gradually decreases moving away from the central area, the outer edge of the transition is formed to be substantially rectangular, and the orientation of the transition area is substantially the same as the central area.

9. The golf club head according to claim 7, wherein the thin-walled portion of the face portion has an inflected shape where a first region along the crown portion side connects to a second region along the sole portion side.

10. The golf club head according to claim 1, wherein the crown portion is constituted by a first peripheral area along the face portion and a first main body area, the sole portion is constituted by a second peripheral area along the face portion and a second main body area, and a golf club head main body having an opening surrounded by the two main body areas is formed, by the first main body area of the crown portion and the second main body area of the sole portion, a face member is constituted by the face portion, the first peripheral area and the second peripheral area, the golf club head is formed by the first and second peripheral areas of the face member being joined to a periphery of the opening of the golf club head main body, and the readily deformable portion is formed in the second main body area.

11. A golf club head comprising:

a face portion including a face surface configured to hit a golf ball;

a crown portion; and a sole portion, wherein the face surface has a thin-walled portion in a peripheral portion on a toe side, wherein a thickness of the thin-walled portion is the smallest in the face surface, wherein the sole portion has, at least on a heel side, a readily deformable portion extending in a toe-heel direction, and wherein the thickness of the thin-walled portion is 1.0 to 1.8 mm.

12. A golf club head comprising:

a face portion including a face surface configured to hit a golf ball;

a crown portion; and a sole portion, wherein the face surface has a thin-walled portion in a peripheral portion on a toe side, wherein a thickness of the thin-walled portion is the smallest in the face surface, wherein the sole portion has, at least on a heel side, a readily deformable portion extending in a toe-heel direction, and wherein the thickness of the central area is 3.0 to 4.2 mm, and the thickness of the thin-walled portion is 1.0 to 1.8 mm.

* * * * *